United States Patent [19]

Galloway et al.

[11] Patent Number: 4,846,780

[45] Date of Patent: Jul. 11, 1989

[54] CENTRIFUGE PROCESSOR AND LIQUID LEVEL CONTROL SYSTEM

[75] Inventors: Jimmie G. Galloway, Missouri City, Mo.; Lonny R. Kelley; Mark E. Ehrhardt, both of Houston, Tex.; Tracy A. Fowler, Kennewick, Wash.

[73] Assignee: Exxon Production Research Company, Houston, Tex.

[21] Appl. No.: 230,646

[22] Filed: Aug. 10, 1988

[51] Int. Cl.[4] ..... B04B 11/02

[52] U.S. Cl. ..... 494/3; 494/37; 494/45

[58] Field of Search ..... 494/2, 1, 3, 4, 5, 6, 494/10, 22, 25, 23, 37, 44, 45; 422/72; 210/781, 782

[56] References Cited

U.S. PATENT DOCUMENTS

| | | | |
|---|---|---|---|
| 1,433,342 | 10/1922 | Coote . | |
| 1,782,028 | 11/1930 | Burch . | |
| 2,941,712 | 6/1960 | Cook . | |
| 3,189,268 | 6/1965 | Nilsson . | |
| 3,409,214 | 11/1968 | Thylefors . | |
| 3,445,061 | 5/1969 | Nilson | 494/3 |
| 3,791,575 | 2/1974 | Kartinen et al. . | |
| 3,817,446 | 6/1974 | Erickson et al. . | |
| 3,960,319 | 6/1976 | Brown et al. . | |
| 4,014,498 | 3/1977 | Broadwell | 949/3 |
| 4,044,943 | 8/1977 | Brown et al. . | |
| 4,175,040 | 11/1979 | Sammons et al. . | |
| 4,626,237 | 12/1986 | Galloway . | |
| 4,636,319 | 1/1987 | Stroucken . | |
| 4,687,572 | 8/1987 | Budzich . | |

*Primary Examiner*—Robert W. Jenkins

[57] ABSTRACT

A centrifugal method and apparatus capable of separating a fluid stream composed of a plurality of components with differing specific gravities. The stream contemplated for separation is that of a producing oil well with components of oil, water, natural gas, and particulates. The method and apparatus use centrifugal forces to separate the gaseous, solid, and liquid components from each other. After separation is completed, detector and sensor arrangements are used to maintain liquid levels in the separator and to control the removal of the individual separated fluids from the apparatus.

42 Claims, 5 Drawing Sheets

CENTRIFUGE PROCESSOR AND LIQUID LEVEL CONTROL SYSTEM

FIELD OF THE INVENTION

The present invention relates to a method and apparatus for separating the components of a fluid stream comprising gas, liquids, and solids. Specifically this invention refers to a centrifugal type separator and the control system employed to maintain proper fluid levels in the separator and to reduce impurities in each component discharged from the separator. Although this invention will be discussed in the context of hydrocarbon production in the form of oil and gas, it is envisioned that the centrifuge method and apparatus may be used to separate any fluid stream with multiple components having more than one specific gravity.

BACKGROUND OF THE INVENTION

The initial separation of the numerous stream components contained in an oil or gas well stream is one of the most basic operations in the production of oil and gas. Typically, a hydrocarbon well stream contains numerous components, including natural gas, hydrocarbon liquids, produced water, and particulates (such as sand). It is necessary to separate these four components before the oil and gas may be sold or used in the production operations.

Gravity separation vessels are usually used to separate the well stream components. A typical production facility would include at least two such vessels: a free-water knockout vessel and a production separator. Both vessels have a steel shell with internal weirs and baffles. During production, the well stream would be produced through the free-water knockout vessel to remove a large portion, generally 60%–90%, of the free water from the well stream. The separator then further separates the remaining well stream components of gas, oil, and produced water into the individual components. The oil is discharged from the production separator to another vessel for additional treating for sale. The water from the production separator is discharged and sent to yet another vessel where the small amount of oil that may have remained in the water is removed. This treated water will then be handled as waste. The gas component also exits the production separator and is sent to a gas handling facility where it will be treated for sale or use. Any sand produced will accumulate in the free-water knockout vessel and production separator until these vessels are removed from service and cleaned.

As is seen from this brief description, many pieces of separation equipment are typically used in the production of oil and gas. Each piece is expensive to install, maintain, and operate.

The weight and space requirements of the separation equipment is of particular concern for an offshore platform. When offshore production facilities are mounted on platforms in tens, hundreds, or even thousands of feet of water, space is extremely expensive to provide. Reducing the size and weight of each piece of equipment can reduce the size of the offshore platform. It is on the offshore platform that this present invention will be such a valuable piece of equipment. There is a need for a single, small, relatively light weight piece of equipment which separates relatively large volumes of oil, gas, and water and which replaces the large, heavy, expensive, vessels used in the past.

Centrifugal equipment has been suggested for use in separating the multiple components of an oil or gas stream. In the typical arrangement the well stream fluids are introduced in the separator and rotated against the centrifuge wall. Layers of the individual components are formed with the specific gravities of the component layers decreasing as the distance from the wall increases. After separation is completed, the individual separated layers are then removed. This removal process can be extremely difficult. As stated in U.S. Pat. No. 3,791,575 (cl 1 1n 15–18), the flow control of the discharge fluids from a centrifugal separator presents a significant problem to the operation of a centrifuge. Various level control systems for centrifugal separators have been proposed to control the levels and the continuous separation of the inlet stream. Examples of level control systems include inlet controls as described in U.S. Pat. No. 1,794,452; differential pressure controls as described in U.S. Pat. No. 4,687,572; flow rate controls as described in U.S. Pat. No. 2,941,712; discharge fluid analysis as described in U.S. Pat. No. 4,622,029; water recirculation control as described in U.S. Pat. No. 3,208,201; and an adjustable overflow weir control as described in U.S. Pat. No. 4,175,040.

Depending on the service efficiency required by a given centrifuge separator, the above described centrifuges and their respective fluid level control systems can be effective and adequate. The principal disadvantage with the centrifugal systems disclosed in the past is their inability to obtain essentially complete separation of the well stream components. A partial separation of fluids is often not acceptable.

In an offshore oil and gas operation where produced water will be disposed by placing the produced water back into the body of water where the platform is located, it is desirable that nearly no oil (usually less than 50 parts per million) be contained in the disposed water.

In an onshore operation, such complete separation is also desirable where produced water is disposed through disposal or injection wells. If oil is contained in water that is injected into a disposal well, the oil will eventually plug the formation and will require workover expenses to regain water disposal or injection capabilities.

The present centrifuge and level control system is intended to reliably separate the oil, gas, water, and sand components of a well stream.

SUMMARY OF THE INVENTION

This present invention is a centrifuge method and apparatus for separating the components of a stream comprised of a plurality of fluids having different specific gravities. This invention is characterized by the highly efficient, continuous separation of a well stream containing oil, water, gas, and some smaller volume of sand or other particulates by a single piece of equipment. The separation of the stream phases is accomplished by the use of a rotor, a fluid layer detection and sensor arrangement, and fluid removal scoops.

In the basic embodiment of the centrifuge processor, a rotor capable of rotating about its rotational axis, receives a fluid stream which is accelerated to the rotor wall. Any gas present in the inlet stream will separate from the liquids upon entering the rotor. The gas will then exit the centrifuge through a gas scoop whose passage opening will be controlled by a pressure regulator which will allow gas to flow from the centrifuge when a specified pressure is reached. After the fluids have reached the rotor wall, they travel along the wall where they are separated into their individual components, with the higher specific gravity fluid (water) forming a fluid layer next to the liner and the lower specific gravity fluid (oil) forming a fluid layer on the higher specific gravity fluid. When the fluid reaches the opposite end of the rotor from where it was fed, the streams have separated into their individual components. The oil layer then flows over a weir and into an oil fluid retention chamber. When the oil level in this chamber reaches a specified height, a level control system utilizing a detector arrangement and a caged rotating float will open a flow passage from the oil fluid retention chamber and allow the oil to exit the centrifuge. The water will then flow into a water fluid retention chamber. When the water level in this chamber reaches a specified height, a level control system utilizing a second detector arrangement and a second, caged rotating float will open a flow passage from the water fluid retention chamber and allow the water to exit the centrifuge.

If it is anticipated that the well stream will contain sand or other solid particles, a second embodiment of the centrifuge processor would be used. The second embodiment would include a second, smaller rotor that would be mounted inside the rotor mentioned in the basic embodiment. The well stream would be accelerated first in the second, smaller rotor with any sand or other solids in the well stream being moved to the edge of this second rotor and removed through a sand/water scoop. The remaining well stream fluids will flow out of the second smaller rotor onto the impeller and into the main rotor and separated as described in the first embodiment above.

Other additional elements to further the efficiency of the centrifuge separator are also described herein.

DESCRIPTION OF THE PREFERRED EMBODIMENTS

Figure 1:
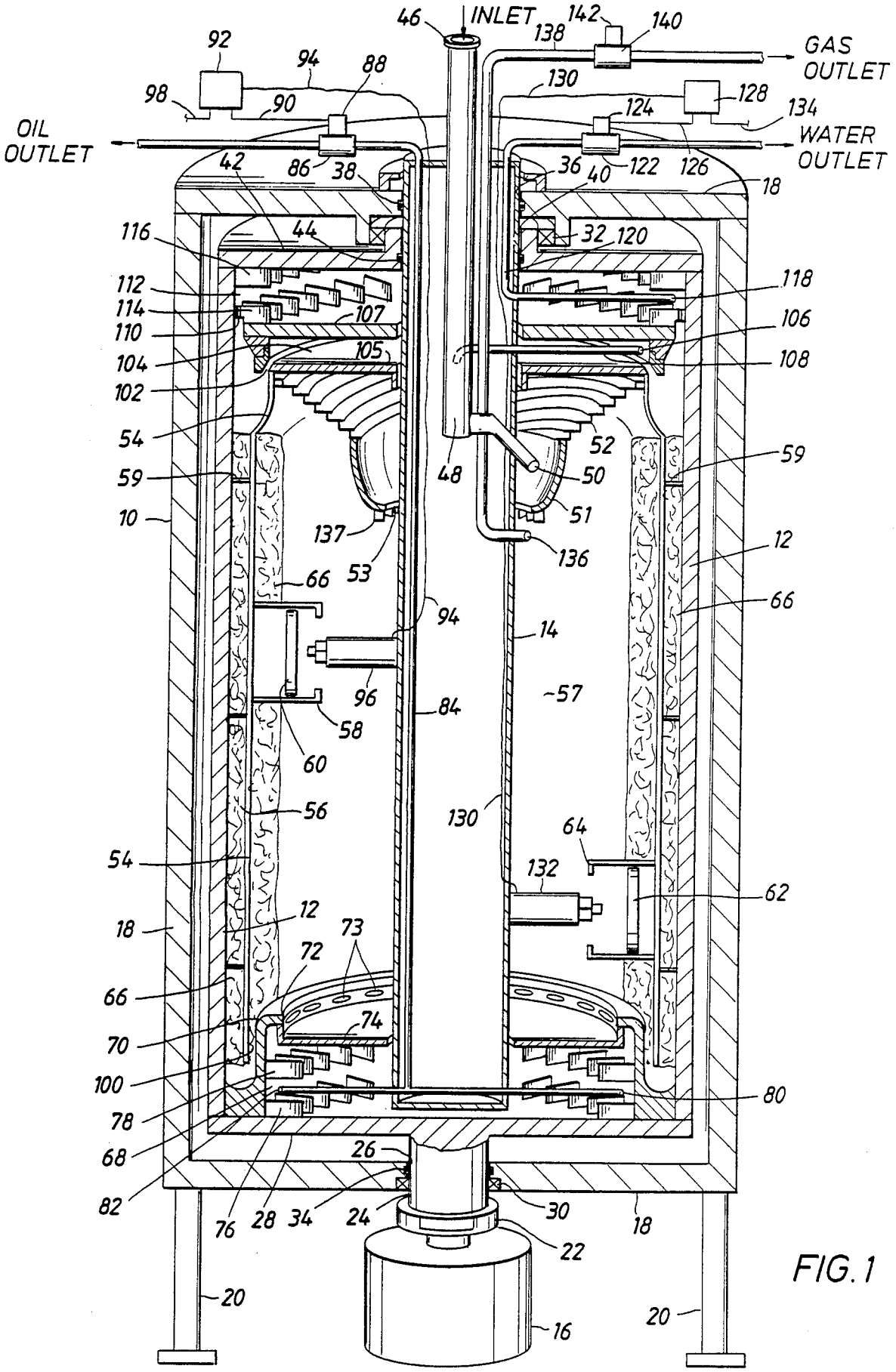
FIG. 1 is an elevation view. partly in section, of a first embodiment of the centrifuge processor.

As seen in FIG. 1, centrifuge 10 is composed of a cylindrical shaped rotor 12 capable of rotating around stationary centerpost 14. High speed electric motor 16, or other high speed device, rotates rotor 12 around centerpost 14 at rates of speed adequate to separate the different specific gravity fluid components in the inlet well stream. Rotor 12 is encased by stationary, protective containment vessel 18 standing on legs 20. Although FIG. 1 shows centrifuge 10 in an upright position on legs 20, centrifuge 10 may be operated in any position. The gravity forces in centrifuge 10 exerted on the fluids being separated, as will be discussed later, are of a very small force relative to the large centrifugal force exerted on the fluid by the rotational motion of rotor 12. Accordingly, centrifuge 10 may be operated with the rotational axis of rotor 12 (i.e. centerpost 14) in a vertical, horizontal, or any other directional orientation. Also, since centrifuge 10 can be mounted to a column or any other stable structure, legs 20 are not essential to the construction of the centrifuge.

High speed electric motor 16 is connected by coupling 22 to driveshaft 24, which extends into protective containment vessel 18 through opening 26. Driveshaft 24 attaches to bottom end cap 28 of rotor 12. Rotor 12 is aligned inside protective containment vessel 18 by lower bearing 30 around driveshaft 24 and by upper bearing 32. This alignment allows rotor 12 to rotate concentrically about centerpost 14 without touching protective containment vessel 18. Because of the significant amount of kinetic energy rotor 12 has during operation, protective containment vessel 18 should be constructed to withstand the damaging effects in the event of a failure of the rotating parts of centrifuge 10 and to ensure safe operation. Lower seal 34 is used to keep fluids that may have leaked from rotor 12 from exiting protective containment vessel 18.

In the preferred embodiment, centerpost 14 extends through opening 36 of protective containment vessel 18. Between centerpost 14 and protective containment vessel 18 is upper seal 38 which prevents fluid leakage from protective containment vessel 18 into the atmosphere or other medium surrounding protective containment vessel 18. Centerpost 14 also extends through opening 40 in top end cap 42 of rotor 12 and down through the interior of rotor 12. Pressure seal 44 also prevents leakage from rotor 12 into protective containment vessel 18. A centerpost is not required to extend the entire length of rotor 12 as shown in FIG. 1. Centerpost 14, as shown, serves as an effective method to centrally locate and support necessary flow passages and control lines from the centrifuge interior to the outside of rotor 12 and out through protective containment vessel 18. Other methods, such as individually extended flow line passages, may also be used to locate and support such flow passages and control lines.

In this embodiment, centerpost 14 is hollow. This allows feed and exit flow passages and control sensing lines to be run through centerpost 14 and into the center of rotor 12. Fluid stream feed flange 46 allows fluid input into rotor 12 through inlet passage tube 48 which extends through centerpost 14 and out through fluid feed nozzle 50. Fluid feed nozzle 50 extends out of centerpost 14 into accelerator bowl 51 and near feed accelerator impeller 52. Accelerator bowl 51 and feed acceleration impeller 52 are mounted inside rotor 12 for rotation with rotor 12.

Figure 3A:
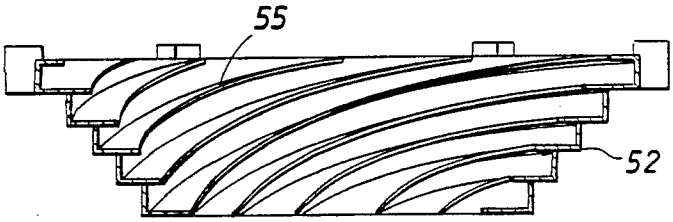
FIG. 3A is a cross-sectional view of an acceleration impeller.
Figure 3B:
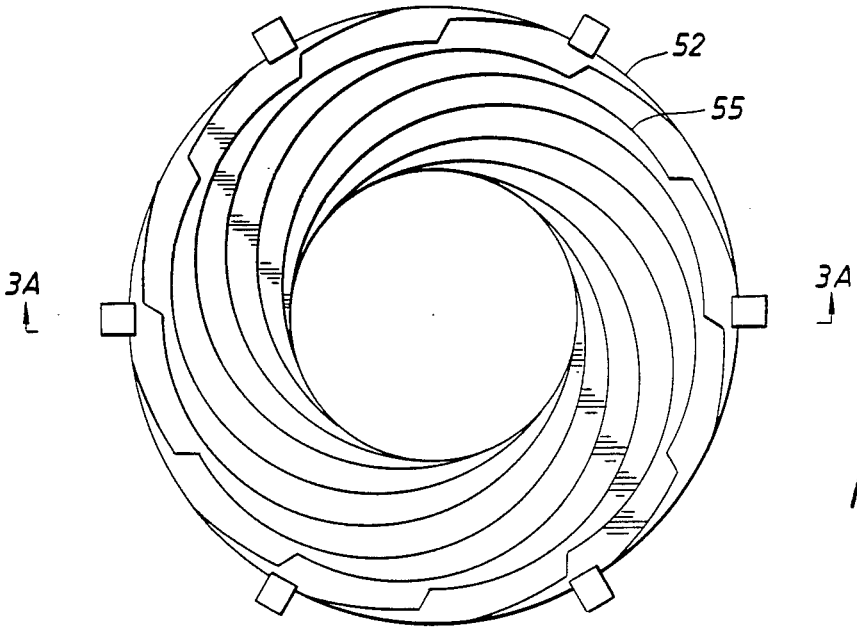
FIG. 3B is a plan view of an acceleration impeller.

FIGS. 3A and 3B show side and plan views, respectively, of acceleration impeller 52. The function of acceleration impeller 52 is to efficiently move the fluids entering rotor 12 from no rotational motion to a rotational motion adequate to achieve separation. In order to save space and material requirements, it is desireable to achieve this acceleration of fluids in as small a portion of rotor 12 as possible. This is accomplished by vanes 55 in impeller 52 which help prevent slippage of the fluid on impeller 52. Referring back to FIG. 1, opening 53 is formed between centerpost 14 and acceleration bowl 51 to allow the passage of gas from acceleration bowl 51 into main opening 57 of centrifuge 10.

Also mounted inside rotor 12 is liner 54 which extends nearly the entire length of rotor 12. Small fluid flow passage 56 is formed by the space between the inner surface of rotor 12 and liner 54. Liner 54 is attached through spacers 59 to rotor 12 for rotation with rotor 12. As the liquids move off of acceleration impeller 52 and begin rotating on the inner surface of liner 54, the liquids separate into their different components. In a typical well stream, these different components are a lighter fluid (oil) and a heavier fluid (water). The heavier fluid will form a fluid layer on liner 54 and the lighter fluid will form a fluid layer on the heavier fluid layer. Mounted on liner 54 is liquid level float cage 58 which houses liquid level float 60. Liquid level float cage 58 is attached to liner 54 for rotation with rotor 12. As the liquids and float 60 rotate on liner 54, there is no relative rotational movement between the liquids and liquid level float 60. Liquid level float 60 has a specific gravity less than the lighter fluid and therefore floats on the lighter fluid layer surface. Float 60 is mounted within float cage 58 so that it will move radially in or out toward the center of the rotor as the lighter fluid layer surface thickness increases or decreases.

A second liquid level float, liquid level float 62, is also cage mounted within a second cage, liquid level float cage 64, to detect slight radial movement on the interface between the heavier fluid and the lighter fluid. Liquid level float 62, in order to float on the fluid interface between the heavy fluid layer and the light fluid layer, has a specific gravity between the specific gravity of these two fluids. Typically, the specific gravity of a crude oil will be approximately 0.80 and of produced brine water approximately 1.05. Therefore, liquid level float 62 would have a specific gravity between about 0.80 and about 1.05. Float cage 64 is also mounted to liner 54 for rotation with rotor 12. Accordingly, there is no relative rotational movement between float 62 and the fluids during operation of rotor 12. The locations of the floats and float cages may be anywhere along liner 54.

Although the preferred embodiment describes a fluid level detector system utilizing a float arrangement, any detector system capable of detecting the thickness of the lighter and heavier fluid layers and the locations of the interfaces could be incorporated to replace the float arrangement. Also, tests with the centrifuge apparatus have shown that the liner, which reverses flow and increases the separation time for the water, is not critical to separation; however, the most efficient separation is achieved with the liner in place.

Along and underneath liner 54 is mounted coalescing mesh 66, which is used to assist in the formation of larger droplets of the lighter fluid during the separation phase. By forming larger droplets of the lighter fluid, the separation of the fluids occurs much more rapidly and efficiently. Coalescing mesh 66 also helps in maintaining the rotation speed of the fluids in rotor 12 by preventing slippage between the heavier fluid and the rotor wall. In the preferred embodiment a crushed polyethlyene matting is used to form an effective and easy to make coalescing mesh 66. Mesh 66 may also be formed from expanded metal or be replaced by vanes, spikes, or any other material or surface that provides contact areas for the formation of larger oil droplets.

At one end of rotor 12, oil retention chamber 68 is formed by a plate 70 which is attached to the inside of rotor 12 for rotation with rotor 12. The front of chamber 68 is formed by weir 72 and plate 74. The back of chamber 68 is formed by the inside face of bottom end cap 28. When enough oil accumulates in rotor 12, it will spill over weir 72 through openings 73, which are behind weir 72, and will flow into chamber 68. Inside chamber 68 are vanes 76 and vanes 78 which maintain and assist the fluid rotation in chamber 68. Vanes 76 and 78 are also connected to and rotate with rotor 12. Each of the pieces (plate 70, weir 72, and plate 74) that form oil retention chamber 68 and vanes 76 and 78 rotate with rotor 12. These components may be individually connected to rotor 12 or assembled and collectively connected to rotor 12.

Fluid scoop 80 and fluid scoop 82 extend into chamber 68 from centerpost 14. The use of fluid scoops to remove fluid from a centrifuge is well known to those skilled in the art and does not require any further discussion here. Fluid scoop 80 and fluid scoop 82 connect to flow passage 84 that extends through centerpost 14 and out through valve 86. Valve 86 is actuated by a valve operator 88. Valve operator 88 receives from signal controller 92 a control signal through control line 90. Signal controller 92 is a typical controlling device that receives an indicating signal from a sensing element, compares it to the set level, and produces an output control signal to achieve a desired control function. Here, signal controller 92 receives its indicating signal through control line 94 from position sensor 96 that is mounted to centerpost 14. Position sensor 96 detects the relative position of rotating float 60 to determine the position of the oil layer surface.

Signal controller 92 receives operating energy, such as electric, pnuematic, or hydraulic, from source 98. Position sensor 96 may use magnetic, optic, electric, ultrasonic or any other available sensing method to determine the relative position of float 60. This embodiment uses an electronic pulse sensor. Signal controller 92 is capable of receiving an electronic pulse signal generated by position sensor 96 as it responds to rotating float 60. Sensor 96 may be arranged so that as the float moves further from liner 54 (and closer to position sensor 96), the signal from the sensor would increase or visa versa. In the first case, for example, as rotating float 60 moves further from liner 54 indicating an increase in oil in rotor 12, controller 92 would receive an electronic pulse signal from position sensor 96 and compare the signal to its set point. When necessary to control valve 86, signal controller 92 would produce an output signal (typical output signals are in the form of an electrical 4-20 milliampere signal) to valve operator 88 through control line 90 to open valve 86 to allow oil to be discharged from rotor 12. As oil is discharged and the level goes down, sensor 96 would relay to controller 92 that enough oil has left rotor 12 and the proper oil level has been reached and that valve 86 should be closed. As more oil enters the centrifuge, the cycle would be repeated.

Beneath weir 72 and plate 70 is flow passage 100 for the higher specific gravity fluid. Flow passage 100 is formed between plate 70 and the inner surface of the lower end of liner 54. Water flows through passage 100, reverses directions, and flows through passage 56, which is formed by the outer surface of liner 54 and the inside surface of rotor 12. Near the upper end of passage 56 is spillover port 102 that connects passage 56 to fluid retention chamber 104. The lower end of chamber 104 is formed by plate 105 that is attached to liner 54 for rotation with rotor 12. The upper end of chamber 104 is formed by plate 107 also mounted for rotation with rotor 12. Any oil that did not flow over weir 72 and into chamber 68 and that instead went through flow passage 100 into passage 56, will be forced into chamber 104 for removal by fluid scoop 106 which extends into chamber 104. Fluid scoop 106 connects to flow passage 108 which connects and empties into fluid feed flow nozzle 48 for recirculation of this oil that reached the water removal area. Above spillover port 102, near the inside wall of rotor 12, is flow passage 110 through which water flows to water retention chamber 112. The lower end of chamber 112 is formed by plate 107. The upper end of chamber 112 is formed by the inside face of top end cap 42. Inside chamber 112 are vanes 114 and vanes 116 which maintain and assist the fluid rotation in chamber 112. Vanes 114 and 116 are connected to and rotate with rotor 12. Like oil retention chamber 68, the pieces forming water retention chamber 112 may be individual components connected directly to rotor 12 or can be assembled and collectively connected to rotor 12.

Figure 4:
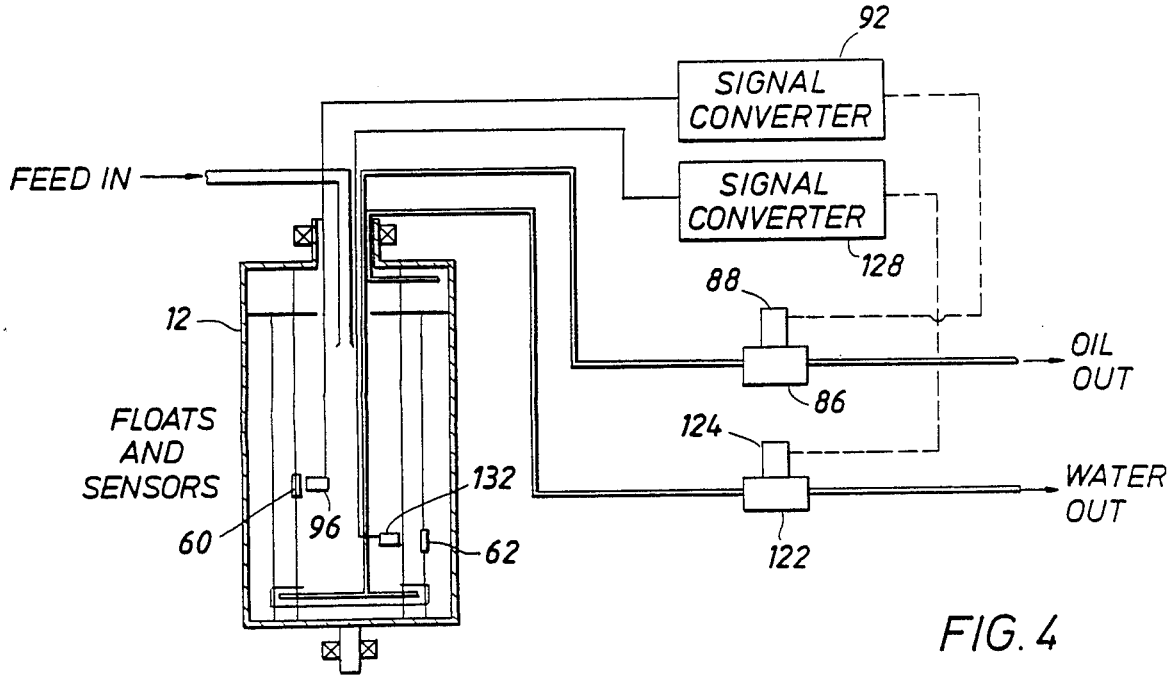
FIG. 4 is a schematic of the control system for fluid removal.

Fluid scoop 118 extends into chamber 112 and connects to flow passage 120 which extends through centerpost 14 and out through valve 122. Valve 122 is actuated by valve operator 124. Valve operator 124 receives from signal controller 128, a control signal through control line 126. The operation of controller 128 is similar to the operation controller 92 as previously discussed. Controller 128 receives its indicating signal through control line 130 from position sensor 132 that is mounted to centerpost 14. Signal controller 128 receives operating energy from source 134. Position sensor 132 detects the relative position of float 62 to determine the water layer thickness. The operation of position sensor 132 is similar to the operation of position sensor 96 as previously discussed. FIG. 4 shows a simplified control system for the level control system described above.

Near accelerator bowl 51 is gas scoop 136. Mounted on accelerator bowl 51 are gas accelerator vanes 137. Vanes 137 assist in removing any small liquid droplets that may be entrained in the gas phase before the gas enters gas scoop 136. Gas scoop 136 is attached to gas flow passage 138 that extends through centerpost 14 and out through valve 140. Valve 140 is a pressure regulating valve that is actuated by valve operator 142 to maintain a preset internal pressure on the interior of rotor 12.

Figure 2:
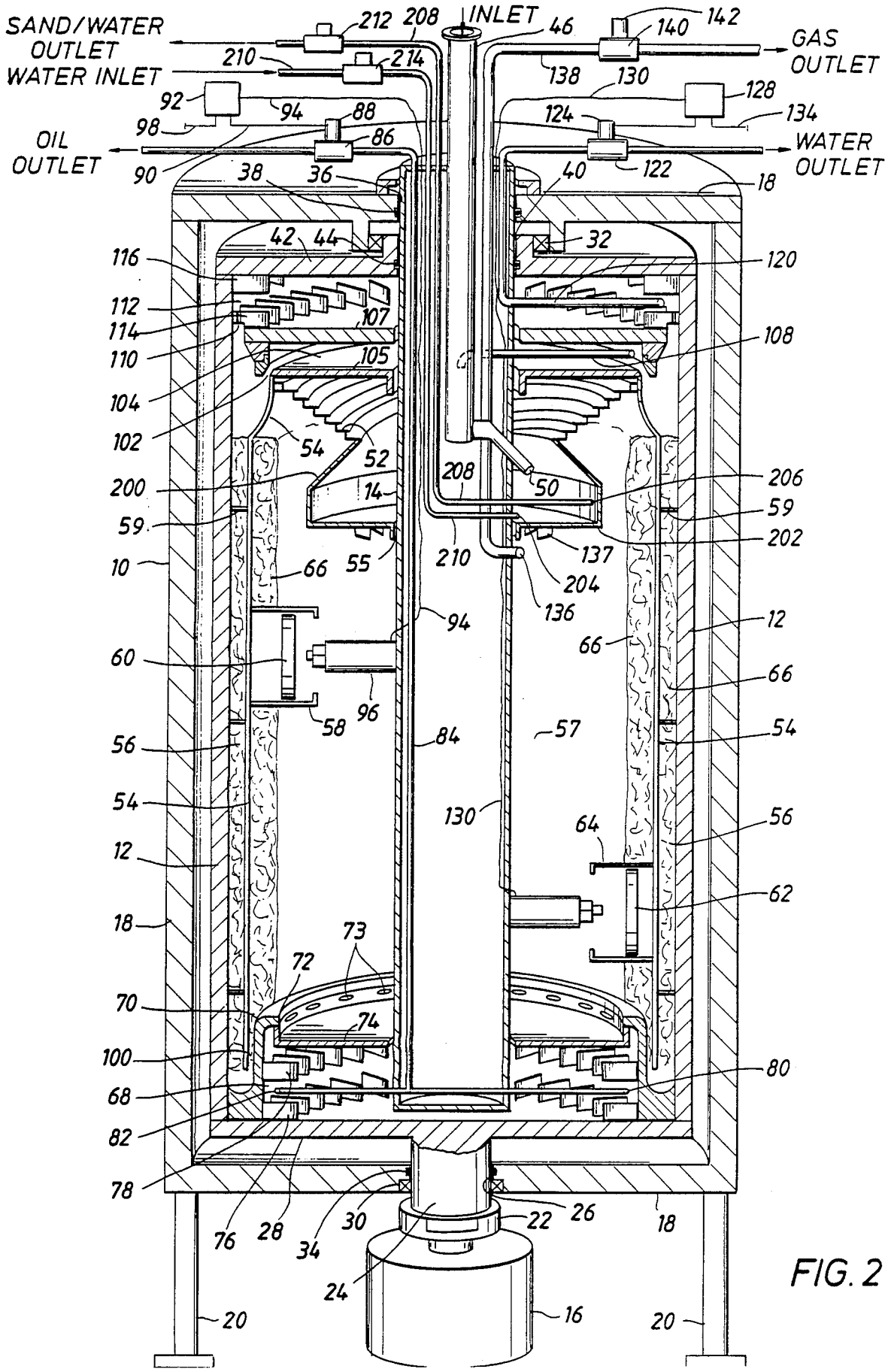
FIG. 2 is an elevation view, partly in section, of a second embodiment of the centrifuge processor.

FIG. 2 shows a second embodiment of rotor 12 and its level control system. This second embodiment has the capabilities of the first embodiment and can additionally remove particulates from the production stream. FIG. 2 has basically the same components as FIG. 1, but also contains an inner rotor assembly 200. The inner rotor assembly 200 comprises an inner rotor 202, clean water feed nozzle 204, sand/water scoop 206, sand/water flow line 208, and clean water flow line 210. In the second embodiment, fluid feed nozzle 50 is positioned to feed the production stream into the inner rotor assembly 200. Opening 55 is formed between centerpost 14 and inner rotor assembly 200 which allows the passage of gas from inner rotor 202 into main opening 57 of centrifuge 10.

The primary function of inner rotor assembly 200 is to separate and remove sand particles from the inlet production stream. Inner rotor 202 is attached feed accelerator impeller 52 and liner 54 for rotation with rotor 12. Sand/water scoop 206 extends from centerpost 14 into inner rotor 202. Clean water feed nozzle 204 also extends into inner rotor 202 from centerpost 14. The sand/water mixture picked up by scoop 206 is discharged out through flow passage 208 that runs up centerpost 14 and out of rotor 12 through orifice 212.

Figure 5:
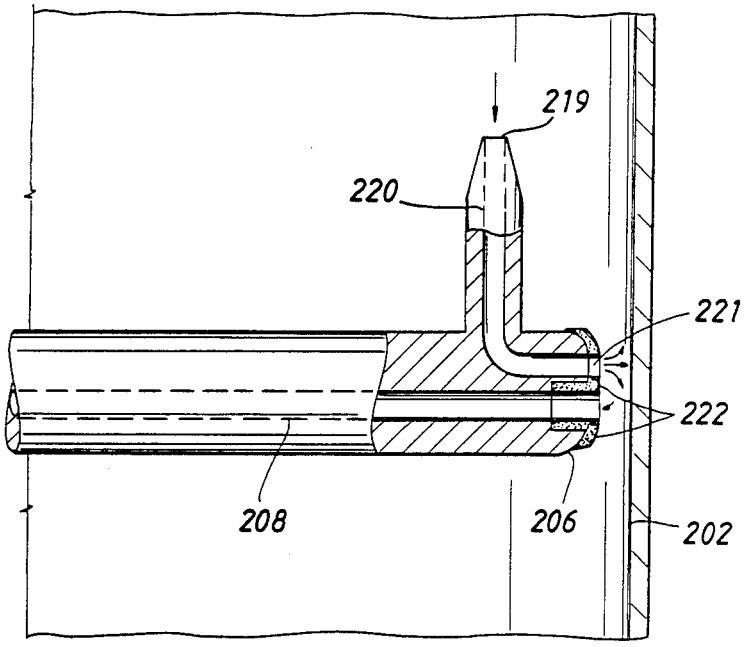
FIG. 5 is a plan view, partly in section, of a sand/water scoop and agitator.

FIG. 5 shows a sand/water scoop 206 in greater detail. As seen in FIG. 5, scoop 206 has a protruding fluid nozzle 219 that connects to passage 220 through scoop 206 to opening 221. Nozzle 219 directs water in rotor 202 through passage 220 and out opening 221 to agitate the sand next to the rotor wall and help it move into scoop 206 and out through flow passage 208. The outer end of scoop 206 which is closest to inner rotor 202, because of the erosional effects of the sand impinging on scoop 206, preferably includes an erosion resistant surface covering 222. It has been found that a man-made diamond plate is effective in reducing this erosion. However, any erosion resistant material may be used. Orifice 212 may be an adjustable needle valve or a positive choke to control the rate that the sand/water mixture leaves the inner rotor assembly 200. Attached to water feed nozzle 204 is clean water flow passage 210 that extends through centerpost 14. Clean water flow passage 210 has orifice 214 to control the rate of clean water introduction through clean water feed nozzle 204.

IN OPERATION

The operation of the centrifuge and the liquid level control system will now be discussed with reference to FIG. 1.

High speed electric motor 16 is engaged to rapidly turn drive shaft 24 through coupling 22. Drive shaft 24 spins rotor 12 around stationary centerpost 14 inside protective containment vessel 18. The rotational speed required to achieve adequate separation of well stream components will be dependent on the diameter of rotor 12. If rotor 12 has a large diameter, the rotational speed to achieve separation will be smaller than the rotational speed required of a smaller diameter rotor 12. For effective separation it is desirable to rotate rotor 12 so that the fluids experience an centrifugal force of at least 1000 times the accelerational force due to gravity (1000 g's) along liner 54 and at the rotor wall. Rotor 12 is positioned by upper bearing 32 and lower bearing 30 to insure rotor 12 is centered in and does not contact protective containment vessel 18. Any fluid that may leak from rotor 12 is prevented from leaking from containment vessel 18 by lower seal 34 and upper seal 38. The fluid stream to be separated is introduced through feed flange 46 into flow passage 48 and out of fluid feed nozzle 50 into accelerator bowl 51. Upon exiting fluid feed nozzle 50, the production stream fluid begin rotating in accelerator bowl 51. As the fluid moves out of bowl 51, the fluid is further accelerated along feed accelerator impeller 52 towards liner 54. As the fluid reaches rotor 12 speed, the differences in the specific gravities of the individual fluid components are magnified by the centrifugal force being exerted on the fluid components. As it reaches liner 54, the fluid begins separating into layers of its various components by differing specific gravity. For a typical oil well stream containing crude oil and brine water, this would mean a water layer adjacent to liner 54 and an oil layer floating on the water layer with the two layers separated by an oil-water interface. In an effort to create equal fluid layer thicknesses along liner 54 and as the well stream is separated into its individual components, the fluid layers begin flowing towards the other end of centrifuge 10 along liner 54. Coalescing mesh 66 assists in the separation of the oil and water by helping to form larger oil droplets which increases the efficiency of the fluid separation. As the oil and water flow through the coalescing section, the smaller oil droplets are provided contact surfaces that promotes the formation of larger oil droplets. The larger droplets can then more easily move to the oil layer and out of the water layer. The coalescing mesh also assists the oil and water fluid layers to maintain synchronous movement with the liner and rotor wall and prevent any slip between the contacted centrifuge surface. Coalescing mesh 66 also helps reduce secondary fluid flows that can occur as the individual separated components move to the fluid removal chambers.

Before the thickness of the combined oil and water fluid layers on liner 54 reaches the height of weir 72, fluid flows through passage 100 and back along passage 56 between liner 54 and rotor 12. When passage 56 is filled and the combined fluid thickness reaches weir 72, the centrifuge is filled to its operating fluid level. The two adjacent fluid layers must now be separated and removed from the rotor.

The rotation of rotor 12 will establish two distinct layers on the inner surface of liner 54, one of oil and the other of water. The introduction into rotor 12 of additional oil and water will cause the spillage of oil over weir 72 into oil retention chamber 68 and water flow through flow passage 110 under liner 54 and on into water retention chamber 112. If enough oil is introduced, oil will flow over weir 72 and through openings 73 and begin filling retention chamber 68. As the chamber is filled, the oil level will rise above weir 72 and cause movement of float 60 floating on the surface of the oil liquid layer inside of float cage 58. As the surface of the oil layer moves, position sensor 96 relays to controller 92 the relative movement of float 60 and therefore necessarily, the movement of the oil layer surface. When the signal corresponds to a preset level in controller 92 indicating a specific oil level height, controller 92 will initiate the necessary control steps to remove oil from chamber 68.

Upon receiving the proper signal from position sensor 96, controller 92 signals valve operator 88 through control line 90 to open valve 86 which will open flow passage 84. When flow passage 84 opens, the angular velocity of the fluid in the oil retention chamber 68 will be converted to dynamic pressure (similar to a centrifugal pump) and will force the oil into fluid scoop 80 and fluid scoop 82 and out flow passage 84. As oil is being removed from centrifuge 10, the oil level in chamber 68 will be lowered which will cause float 60, in float cage 58, to be lowered. The position sensor and the control system will then close valve 86 until the oil level rises again to the preset level and the emptying cycle is repeated. Valve 86 may use opening, closing, or throttling actions to maintain the proper oil level in rotor 12.

The water fluid layer, because of its higher specific gravity, will be formed adjacent to liner 54. As more water is introduced into rotor 12, the water layer thickness increases. As the water layer thickness increases, water will flow through flow passage 100 under oil retention chamber 68, reverse directions, and flow back toward the other end of centrifuge rotor through passage 56, and through flow passage 110. This water movement through flow passage 56, and on through passage 110 will cause water retention chamber 112 to fill. The filling of retention chamber 112 will cause the oil-water interface relative to liner 54 to rise. As the interface rises, interface float 62 inside float cage 64 will also rise and initiate a control sequence similar to the oil level control system previously discussed.

When the interface level reaches a certain, preset location, indicating a specified water layer thickness, position sensor 132 will relay to controller 128 the need to remove water from fluid retention chamber 112. Controller 128 will then signal valve operator 124 through control line 126 to open valve 122 which will open flow passage 120. When flow passage 120 opens, the angular velocity of the fluid in retention chamber 112 will be converted to dynamic pressure and force the water into fluid scoop 118 and out flow passage 120. When enough water is removed from the fluid retention chamber 112, the level of the oil water interface and, therefore, necessarily the distance of float 62 relative to liner 54 will decrease. This movement will be detected by sensor 132 and will ultimately result in the shutting of valve 122 until another signal is received indicating the retention chamber is full which will initiate another water dump cycle. The action of valve 122, like that of valve 86, may be snap acting, on or off, or ma be made to act as a throttling valve, in response to the water layer fluid thickness. As the water travels toward fluid retention chamber 112 in flow passage 56 between liner 54 and rotor 12, it travels through coalescing mesh 66. Mesh 66 assists in the formation of larger oil droplets for any oil that may have not been removed through fluid retention chamber 68. Before any oil that entered flow passage 56 has reached fluid chamber 112, it will be forced next to the inside wall of liner 54 by its smaller specific gravity. This oil, typically called skim oil, will then flow along the inside wall of liner 54 with water through flow passage 102 into fluid retention chamber 104. The mixture of oil and water that flows into chamber 104 is removed through oil/water scoop 106 and placed back through flow passage 108 into flow passage 48 for reseparation. This recirculation method helps insure that no oil will reach the fluid retention chamber 112 and that no oil is discharged out the water flow passage 120.

During the operation of the centrifuge, it is desirable for effective separation that the oil-water interface remain in a predetermined operating range above liner 54. The interface control system should not allow the interface to rise above the height of weir 72 or fall to the level of flow passage 100. If the oil-water interface on liner 54 rises above the height of weir 72, water will flow over weir 72 and spill in retention chamber 68 and be removed by fluid scoops 80 and 82. Alternatively, if the oil-water interface on liner 54 falls to the level of flow passage 100, oil will flow through passage 100, back through passage 56, and potentially enter fluid chamber 112 and be removed through fluid scoop 118. Therefore it is necessary that the oil-water interface remain a distance from liner 54 that is less than the height of weir 72 from liner 54 and more than the distance from the top of flow passage 100 to liner 54, thereby preventing the oil phase from flowing through passage 100 and preventing the water phase from flowing over weir 72.

The preceding description describes method and apparatus for separating a well stream without a significant gas component. If the well stream contains a gas phase, the following occurs. The gas phase is introduced into rotor 12 with the liquids through inlet feed flange 46 and fluid feed nozzle 50. Because of the small density of gas relative to the liquids, the gas is separated from the liquids as it enters bowl 51 and migrates to main opening 57 of centrifuge 10 through opening 53. As the water layer forms in rotor 12 and as the oil layer forms on the water layer, gas occupies main opening 57 of centrifuge 10 and forms a gas-oil interface at the surface of the oil layer. Gas acceleration vanes 137, which rotate with rotor 12, provide additional separation of any small fluid droplets that might still be entrained in the gas phase. Gas scoop 136 allows the gas to enter passage 138 in centerpost 14 and out rotor 12. Gas flow passage 138 is controlled by gas pressure regulating device 142 and valve 140. As more gas enters rotor 12, the internal pressure of the system increases. When the pressure reaches a designated pressure, pressure regulating device 142 will open valve 140 and allow enough gas to exit the centrifuge to reduce the pressure inside the separator. Such pressure regulating devices and valves are well known in the oil and gas production industry and do not need further discussion here. The fluid stream, free of gas, exists bowl 51 and is accelerated by feed accelerator impeller 52 to full rotor speed where it is separated as described above.

If sand or other particulates are expected to be produced in the fluid stream, the second embodiment of the centrifugal separator and control system would be used. The second embodiment is shown in FIG. 2. The operation of the second embodiment is similar to that of the first embodiment shown in FIG. 1, but has an additional inner rotor assembly 200 and flow passages that remove sand and other solids. Fluid flow nozzle 50 introduces the fluid stream containing the particulates into inner rotor 202 where the fluids begin to be accelerated. The sand and any other solids, after contacting the rotor wall of inner rotor 202, are moved to the large radius area of the inner rotor 202 and into the sand/water scoop 206 that extends from centerpost 14. The sand-/water scoop system, unlike the oil and water removal systems, is a constant bleed system that is continuously removing a small, constant volume stream out of the inner rotor and discharging it out of centrifuge 10 through sand/water passage 208. Sand/water passage 208 may use a small orifice 212 to control the amount of sand and water removed from inner rotor 202. Other controls such as adjustable needle valves or positive chokes are available to provide a constant bleed removal system. A small water stream may be injected through clean water flow passage 210 and feed nozzle 204 into inner rotor 202 to insure that sand/water scoop 206 has a continuous water stream to it and to maintain clean water that assists in "washing" the small oil particles from the produced sand.

It is helpful during the removal of the sand from the wall of inner rotor 202 to agitate the sand immediately in front of sand/water scoop 206. FIG. 5 shows a view of fluid scoop 206 that incorporates a particulate agitator. Water rotating in inner rotor 202 is jetted through nozzle 219 through passage 220 out opening 221 to a point immediately in front of scoop passage opening 208. As the water is jetted out opening 221, sand is lifted off the wall of inner rotor 202 and picked up by sand-/water scoop 206 for discharge through sand/water passage 208.

The fluid stream, now free of any solids that may have been introduced into the centrifuge, exits inner rotor 202 and is accelerated by feed accelerator impeller 52 to full rotor speed where it is separated as described above.

During the startup of centrifuge 10, it is desirable to prime the separator with a small volume of the heavier fluid to be separated in order to form a fluid layer for control and seal purposes. This sealing would prevent the undesirable possibility of oil going out the water discharge line during startup.

A typical sized oil and water centrifugal separator, with a 10,000 barrels of fluid per day capacity, would be approximately 6 feet (1.83 meters) in length and 3 feet (0.91 meter) in diameter. The volume required to prime a device this size would be approximately 18 gallons of water. As rotor 12 rotates, the prime water would be introduced through feed flange 46 and through flow passage 48 and fluid feed nozzle 50. The prime water would flow out from feed accelerator impeller 52 to liner 54 and through flow passage 100 and into passage 56. This prime water would therefore prevent any produced oil from flooding flow passage 56 and reaching oil retention chamber 112 where it would be discharged through water flow passage 120 as produced water.

Figure 6:
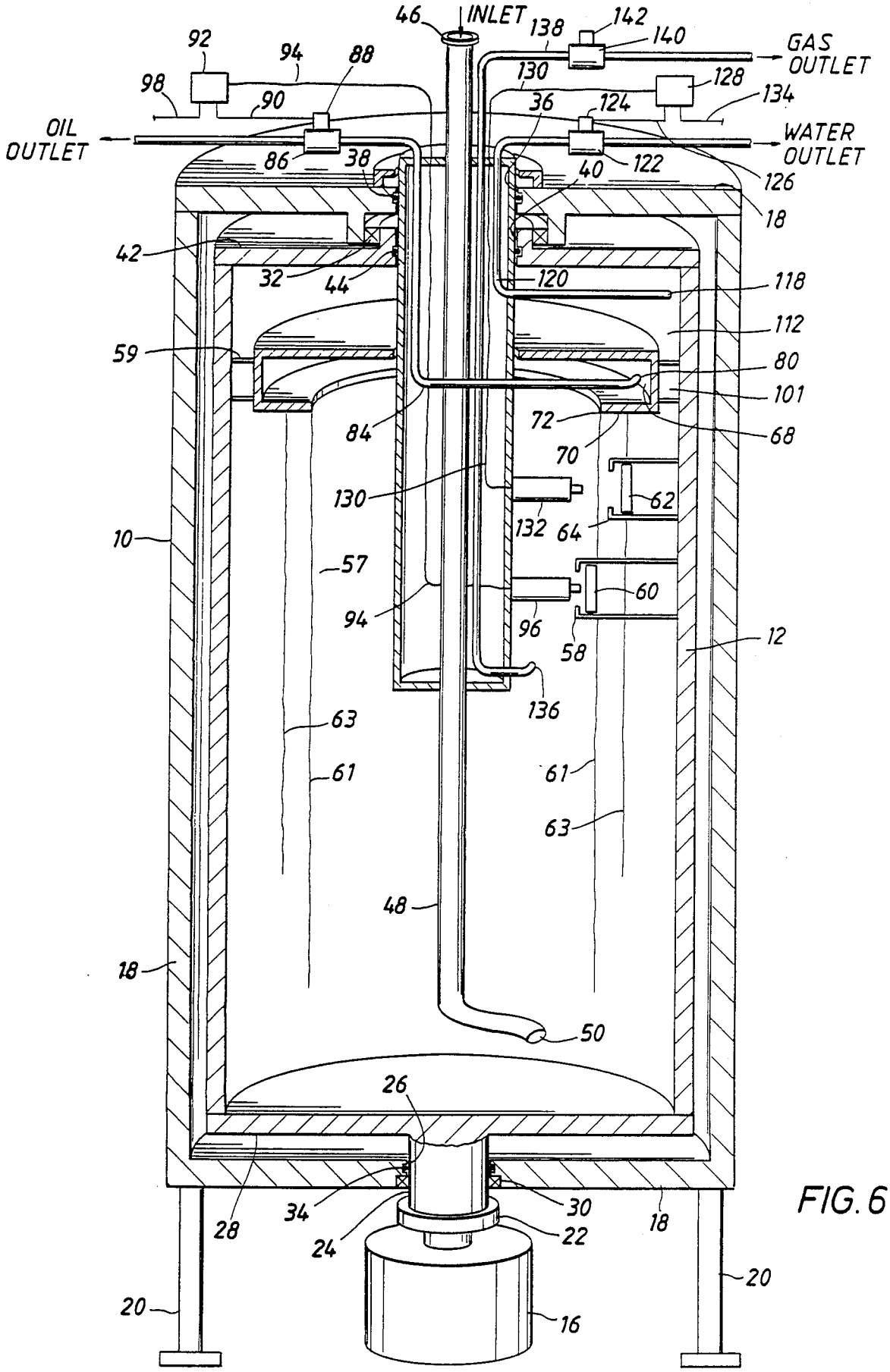
FIG. 6 is an elevation view, partly in section, of still another embodiment of the centrifuge processor.

The centrifuge separator and level control system, as described herein, provide extremely efficient separation of the components of a well stream. However, as previously discussed, several items included in the preferred embodiments shown in FIG. 1 and FIG. 2 are not required for the operation of centrifuge separator. FIG. 6 shows one of many possible apparatus that may be constructed in conjunction with these specifications, but which does not contain every element as previously described in FIG. 1 or FIG. 2.

FIG. 6 shows the basic components of the centrifugal separator of this invention. Items that are not required and are omitted in the embodiment shown in FIG. 6, include an acceleration impeller, an acceleration bowl, a liner, coalescing mesh, vanes, and a skim oil scoop. Also flow passages 100, 110, and 56 of FIG. 1 are replaced by flow passage 101. Flow passage 101 is formed between the bottom of plate 70, which forms oil retention chamber 68, and rotor 12.

In the operation of the embodiment shown in FIG. 6, fluids, introduced into centrifuge 10 through inlet passage 48, exit inlet nozzle 50 and move towards rotor 12. Any gas present moves away from the rotor wall and towards main opening 57 of rotor 12. When enough gas enters rotor 12, the gas pressure will increase and be released through passage 138 as described earlier in the preferred embodiment. The fluids, after separating from the gas, move towards the rotor where they will contact the rotor or other fluids already in the rotor and begin spinning at rotor speed. As the rotating fluids move along the rotor wall, they will separate into their heavier component (water) and lighter components (oil). The water will form a liquid layer immediately adjacent to the rotor wall and the oil will form a liquid layer on top of the water layer. When enough oil enters the centrifuge, it will overflow weir 72 and flow into oil retention chamber 68 and begin filling oil retention chamber 68.

Between the gas and the oil layer is the gas-oil interface 61 on which float 60 floats. When enough oil is produced, the associated level control system, acting with float 60, sensor 96, and controller 92, will open fluid passage 84 to allow the oil to escape just as is described in the operation of the embodiment shown in FIG. 1. Between the oil layer and the water layer is formed oil-water interface 63 on which interface float 62 floats. When enough water is produced, interface float 62 will rise and upon reaching the specified height, will transmit to sensor 132 and controller 128, the need to open flow passage 120 to allow water to escape rotor 12, just as is described in the operation of the embodiment shown in FIG. 1.

It is possible that the scoops and retention chambers may be located at the end opposite from that shown in FIG. 6 or may be located at each end. One or multiple fluid chambers may be located at both ends of rotor 12. Likewise, the float sensors could be placed at any location along rotor wall 12. However, it is advantageous to put the float levels in positions where they will have minimal interference from fluids entering rotor 12. This means the floats would probably be best located near the fluid retention chambers.

As positioned in FIG. 6, the removal of the liquids from the fluid retention chambers by scoop 80 and scoop 112 would cause concurrent flow along the wall of rotor 12. If the scoops and retention chambers were put at opposite ends of the rotor (one scoop and one retention chamber at each end), countercurrent flow would be induced by the removal of the liquids from rotor 12. The preferred embodiment as described in FIG. 1 and FIG. 2 includes several improvements over this basic embodiment that allow for a more complete separation of each fluid component, however; the basic operation of the centrifuge unit is described in FIG. 6.

Numerous tests have been performed using a centrifuge processor shown in FIG. 1 and described herein. Tests with a 2 inches diameter by 30 inches long prototype centrifuge being fed a 50% oil and 50% water mixture showed the following results:

| Rate | Oil Discharge Stream | Water Discharge Stream |
|---|---|---|
| (In total barrels of fluid per day) | (Water in Oil Stream - in Percent) | (Oil in Water Stream - in Parts Per Million) |
| 400 | 0.03 | 10 |
| 1200 | 0.05 | 27 |
| 1800 | 0.10 | 40 |
| | (Typical Sales Specification: <0.50%) | (Typical Disposal Specification: <50 PPM) |

In the prototype centrifuge, fluid passage 56, formed between the inner surface of rotor 12 and the outer surface of liner 54, had a thickness of approximately 0.4 inch (10.2 millimeters). The distance of weir 72 from the inner surface of liner 54 was about 1.0 inch (25.4 millimeters). With liner 54 having a thickness of about 0.1 inch (2.5 millimeters), the distance of weir 72 from rotor 12 was about 1.5 inches (38.1 millimeters).

Float 60, mounted in cage 58 on liner 54 for floatation on the oil layer surface, was capable of slight movement on the oil surface at a distance from the inner surface of rotor 12 approximately equal to the distance between weir 72 and the inner surface of rotor 12 (about 1.5 inches or 38.1 millimeters). The movement of float 60 in cage 58 was on the order of ±0.1 inch (2.54 millimeters). Similarly, interface float 62, mounted in cage 64, was capable of slight movement on the oil-water interface surface about 0.35 inch (8.9 millimeters) from the inner surface of liner 54. Movement of float 62 in cage 64 was on the order of ±0.1 inch (2.54 millimeters).

Larger centrifuge separators may have larger clearances in flow passage 56 for greater fluid handling capacities. Also, as the centrifuge capacity increases, the height of weir 72 may increase for a larger flow passage 100 and 56. An increase in weir height 72 would also necessitate increasing the distance of float 60 and float 62 from liner 54. Accordingly, these distances and dimensions are in no way intended to be absolute design limitations or operating ranges.

It will be apparent to those skilled in art that various changes may be made in the details of construction of the apparatus and the details of the methods as disclosed herein without departing from the spirit and scope of the invention. Such changes in details are included within the scope of this invention as defined in the following claims.

What we claim is:

1. A method for separating the components of a stream comprised of plurality of fluids having different specific gravities, said method comprising the steps of:

introducing the stream into a rotor having a rotor wall and opposed first and second end portions and a plurality of fluid removal sections attached to the rotor;

rotating the rotor to cause a radial separation of the fluids wherein the fluids are forced outward to the rotor wall forming a plurality of fluid layers so that the fluid layer adjacent to the rotor wall has the greatest relative specific gravity and the successive layers approaching the rotor's rotational axis have successively lower specific gravities so that interfaces form between each separated fluid;

detecting the position of each interface by means of detectors; and removing the individual fluids by flowing each fluid into a fluid removal section and removing each individual fluid from the rotor by opening a fluid scoop passage in response to said detecting of each interface when each fluid layer reaches a specified thickness.

2. The method of claim 1 wherein said method further comprises detecting the position of each interface by determining the location of a plurality of floats floating on the interfaces between the layers, each of the floats having a specific gravity less than the specific gravity of the layer on which it is floating and greater than the specific gravity of the layer on which it is submerged.

3. The method of claim 2 wherein at least one of the fluids is a gas, wherein said method further comprises the step of removing the gas when a specified pressure is reached in the gas layer, thereby maintaining a specified rotor pressure.

4. The method of claim 1 wherein at least one of the fluids is a gas, wherein said method further comprises the step of removing the gas when a specified pressure is reached in the gas layer, whereby maintaining a specified rotor pressure.

5. A method for separating the components of a stream comprised of a plurality of fluids having different specific gravities and particulates, said method comprising the steps of:

introducing the stream into a centrifuge having an inner rotor and a main rotor, the inner rotor being inside the main rotor and having a concaved rotor wall, the main rotor having a rotor wall and opposed first and second end portions and multiple fluid removal sections attached to the rotor;

rotating the inner rotor to create a centrifugal force sufficient to move the particulates against the inner rotor wall;

removing the separated particulates from the inner rotor;

spilling the plurality of fluids out of the inner rotor and into the main rotor;

rotating the main rotor to cause a radial separation of the fluids wherein the fluids are forced outward to the main rotor wall forming a plurality of fluid layers so that the fluid layer adjacent to the rotor wall has the greatest relative specific gravity and successive layers approaching the rotor's rotational axis have successively lower specific gravities;

detecting the position of each interface by means of detectors; and removing the individual fluids by flowing each fluid into a fluid removal section and removing each individual fluid from the rotor by opening a fluid scoop passage in response to said detecting of each interface when each fluid layer reaches a specified thickness.

6. The method of claim 5 wherein said method further comprises detecting the position of each interface by determining the location of a plurality of floats floating on the interfaces between the layers, each of the floats having a specific gravity less than the specific gravity of the layer on which it is floating and greater than the specific gravity of the layer on which it is submerged.

7. The method of claim 6 wherein at least one of the fluids is a gas, wherein said method further comprises the step of removing the gas when a specified pressure is reached in the gas layer, whereby maintaining a specified rotor pressure.

8. The method of claim 5 wherein at least one of the fluids is a as, wherein said method further comprises the step of removing the gas when a specified pressure is reached in the gas layer, whereby maintaining a specified rotor pressure.

9. A method for centrifugally separating components of a stream which is comprised of a first liquid and a second liquid, said first liquid being heavier than the second liquid, said method comprising the steps of:

continuously introducing said stream into a rotating rotor having a rotor wall and opposed first and second end portions, the first and second liquids rotating in the rotor to form a first liquid layer and a second liquid layer with an interface between the layers;

sensing movement of the interface between the first and second liquid layers by means of a first sensing means;

sensing movement of the interface between the first and second liquid layers by means of a first sensing means;

sensing movement of the inner surface of the second liquid layer by means of a second sensing means:

extracting the first liquid from the rotor in response to said first sensing means to maintain the interface between the first and second liquids within a predetermined distance from the rotor wall; and extracting the second liquid from the rotor in response to the second sensing means to maintain the level of the inner surface of the second liquid within a predetermined range.

10. An apparatus for separating the components of a stream comprised of a plurality of fluids having different specific gravities, said apparatus comprised of:

a rotor adapted or rotation about an axis, the rotor having a rotor wall and opposed first and second end portions defining an opening inside the rotor;

a fluid feed flow passage mounted in the opening in the rotor to introduce the stream into the rotor;

a heavy fluid chamber attached to the rotor;

a heavy fluid scoop mounted in the opening in the rotor and having a flow passage extending outward from the rotational axis of the rotor and into the heavy fluid chamber for removing heavy fluids from the chamber;

a light fluid chamber attached to the rotor;

a light fluid scoop mounted in the opening in the rotor and having a flow passage extending outward from the rotational axis of the rotor and into the light fluid chamber for removing light fluids from the chamber;

a means for detecting the radial location of a first and a second fluid interface and producing a signal relative thereto;

a means for regulating flow through the heavy liquid scoop in response to said detecting means in locating the radial position of the first fluid interface; and a means for regulating flow through the light fluid scoop in response to said detecting means in locating the radial position of the second fluid interface.

11. An apparatus for separating the components of a stream comprised of a plurality of fluids having different specific gravities, said apparatus comprised of:

a rotor adapted for rotation about an axis, the rotor having a rotor wall and opposed first and second end portions defining an opening inside the rotor;

a fluid feed flow passage mounted in the opening in the rotor to introduce the stream into the rotor;

a heavy fluid chamber attached to the rotor;

a heavy fluid scoop mounted in the opening in the rotor and having a flow passage extending outward from the rotational axis of the rotor and into the heavy fluid chamber for removing heavy fluids from the chamber;

a light fluid chamber attached to the rotor;

a light fluid scoop mounted in the opening in the rotor and having a flow passage extending outward from the rotational axis of the rotor and into the light fluid chamber for removing light fluids from the chamber;

a weir connected to the rotor adjacent to the light fluid chamber and extending radially inwardly from the rotor wall a distance sufficient to permit light fluids to overflow the weir and enter the light fluid chamber;

a first detector for radially locating a first fluid layer interface and producing a signal relative thereto;

a second detector for radially locating a second fluid layer interface and producing a signal relative thereto;

a first signal converter in communication with the first detector capable of receiving the signal produced by the first detector and producing a varying output signal to a means for regulating flow through the heavy fluid scoop;

a second signal converter in communication with the second detector capable of receiving the signal produced by the second detector and producing a varying output signal to a means for regulating flow through the light fluid scoop;

a means for regulating flow through the heavy fluid scoop in response to the varying output signal from the first signal converter, whereby maintaining a specified heavy fluid level; and a means for regulating flow through the light fluid scoop in response to the varying output signal from the second signal converter, whereby maintaining a specified light fluid level.

12. The apparatus of claim 11 further adapted to additionally handle gas, and further comprising:

a third fluid scoop mounted in the opening in the rotor and having a flow passage extending outward from the rotational axis of the rotor for removing gas from the rotor; and a pressure regulating device communicating with the third flow passage, whereby a specified rotor pressure is maintained.

13. The apparatus of claim 12 and further comprising:

a fluid acceleration impeller adapted for rotation with the rotor and capable of receiving fluid from the fluid feed flow passage; and a coalescing material adapted for rotation with the rotor.

14. The apparatus of claim 11 and further comprising:

a fluid acceleration impeller adapted for rotation with the rotor and capable of receiving fluid from the fluid feed flow passage; and a coalescing material adapted for rotation with the rotor.

15. An apparatus for separating the components of a stream comprised of a plurality of fluids having different specific gravities, said apparatus comprised of:

a rotor adapted for rotation about an axis, the rotor having a rotor wall and opposed first and second end portions defining an opening inside the rotor;

a fluid feed flow passage mounted in the opening in the rotor to introduce the stream into the rotor;

a heavy fluid chamber attached to the main rotor;

a heavy fluid scoop mounted in the opening in the rotor and having a flow passage extending outward from the rotational axis of the rotor and into the heavy fluid chamber for removing heavy fluids from the chamber;

a light fluid chamber attached to the rotor;

a light fluid scoop mounted in the opening in the rotor and having a flow passage extending outward from the rotational axis of the rotor and into the light fluid chamber for removing light fluids from the chamber;

a weir connected to the rotor adjacent to the light fluid chamber and extending radially inwardly from the rotor wall a distance sufficient to permit light fluids to overflow the weir and enter the light fluid chamber;

a first float in the opening in the rotor floating on a first fluid interface and adapted for radial movement with respect to the rotational axis of the rotor;

a second float in the opening in the rotor floating on a second fluid interface and adapted for radial movement with respect to the rotational axis of the rotor;

a first detector for radially locating the first float and producing a signal relative thereto;

a second detector for radially locating the second float and producing a signal relative thereto;

a first signal converter in communication with the first detector capable of receiving the signal produced by the first detector and producing a varying output signal to a means for regulating flow through the heavy fluid scoop;

a second signal converter in communication with the second detector capable of receiving the signal produced by the second detector and producing a varying output signal to a means for regulating flow through the light fluid scoop;

a means for regulating flow through the heavy fluid scoop in response to the varying output signal from the first signal converter, whereby maintaining a specified heavy fluid level; and a means for regulating flow through the light fluid scoop in response to the varying output signal from the second signal converter, whereby maintaining a specified light fluid level.

16. The apparatus of claim 15 further adapted to additionally handle gas, and further comprising:

a third fluid scoop mounted in the opening in the rotor and having a flow passage extending outward from the rotational axis of the rotor for removing gas from the rotor; and a pressure regulating device communicating with the third flow passage, whereby a specified rotor pressure is maintained.

17. The apparatus of claim 16 and further comprising:

a fluid acceleration impeller adapted for rotation with the rotor and capable of receiving fluid from the fluid feed flow passage; and a coalescing material adapted for rotation with the rotor.

18. The apparatus of claim 15 and further comprising:

a fluid acceleration impeller adapted for rotation with the rotor and capable of receiving fluid from the fluid feed flow passage; and a coalescing material adapted for rotation with the rotor.

19. An apparatus for separating the components of a stream comprised of a plurality of fluids having different specific gravities and particulates, said apparatus comprised of:

a main rotor adapted for rotation about an axis, the main rotor having a rotor wall and opposed first and second end portions defining an opening inside the rotor;

an inner rotor mounted inside of the main rotor adapted for rotation with the main rotor, said inner rotor having an inner rotor wall defining an opening inside the inner rotor and being adapted to receive flow from a fluid feed flow passage;

a sand/water scoop mounted in the opening in the inner rotor and having a flow passage extending outward from the rotational axis of the main rotor and inner rotor to the wall of the inner rotor for removing sand from the inner rotor;

a sand/water outlet orifice communicating with the flow passage of the sand/water scoop;

a water makeup line mounted in the opening in the inner rotor and having a flow passage extending outward from the rotational axis of the main rotor and inner rotor into said inner rotor;

a water inlet orifice communicating with the flow passage of the water makeup line;

a fluid feed flow passage mounted in the opening in the inner rotor to introduce the stream into the inner rotor;

a heavy fluid chamber attached to the main rotor;

a heavy fluid scoop mounted in the opening in the rotor and having a flow passage extending outward from the rotational axis of the main rotor and into the heavy fluid chamber for removing heavy fluids from the chamber;

a light fluid chamber attached to the rotor;

a light fluid scoop mounted in the opening in the rotor and having a flow passage extending outward from the rotational axis of the main rotor and into the light fluid chamber for removing light fluids from the chamber;

a weir connected to the main rotor adjacent to the light fluid chamber and extending radially inwardly from the rotor wall a distance sufficient to permit light fluids to overflow the weir and enter the light fluid chamber;

a first detector for radially location a first fluid layer interface and producing a signal relative thereto;

a second detector for radially locating a second fluid layer interface and producing a signal relative thereto;

a first signal converter in communication with the first detector capable of receiving the signal produced by the first detector and producing a varying output signal to a means for regulating flow through the heavy fluid scoop;

a second signal converter in communication with the second detector capable of receiving the signal produced by the second detector and producing a varying output signal to a means for regulating flow through the light fluid scoop;

a means for regulating flow through the heavy fluid scoop in response to the varying output signal from the first signal converter, whereby maintaining a specified heavy fluid level; and a means for regulating flow through the light fluid scoop in response to the varying output signal from the second signal converter, whereby maintaining a specified light fluid level.

20. The apparatus of claim 19 further adapted to additionally handle gas, and further comprising:

a third fluid scoop mounted in the opening in the rotor and having a flow passage extending outward from the rotational axis of the main rotor for removing gas from the rotor; and a pressure regulating device communicating with the third flow passage, whereby a specified rotor pressure is maintained.

21. The apparatus of claim 20 and further comprising:

a fluid acceleration impeller adapted for rotation with the rotor and capable of receiving fluid from the fluid feed flow passage; and a coalescing material adapted for rotation with the rotor.

22. The apparatus of claim 19 and further comprising:

a fluid acceleration impeller adapted for rotation with the rotor and capable of receiving fluid from the fluid feed flow passage; and a coalescing material adapted for rotation with the rotor.

23. An apparatus for separating the components of a stream comprised of a plurality of fluids having different specific gravities and particulates, said apparatus comprised of:

a main rotor adapted for rotation about an axis, the main rotor having a rotor wall and opposed first and second end portions defining an opening inside the main rotor;

an inner rotor mounted inside of the main rotor adapted for rotation with the main rotor, said inner rotor having an inner rotor wall defining an opening inside the inner rotor and being adapted to receive flow from a fluid feed flow passage;

a sand/water scoop mounted in the opening in the inner rotor and having a flow passage extending outward from the rotational axis of the main rotor and inner rotor to the wall of the inner rotor for removing sand from the inner rotor;

a sand/water outlet orifice communications with the flow passage of the sand/water scoop;

a water makeup line mounted in the opening in the inner rotor and having a flow passage extending outward from the rotational axis of the main rotor and inner rotor into said inner rotor;

a water inlet orifice communicating with the flow passage of the water makeup line;

a fluid feed flow passage mounted in the opening in the inner rotor to introduce the stream into the inner rotor;

a heavy fluid chamber attached to the main rotor;

a heavy fluid scoop mounted in the opening in the rotor and having a flow passage extending outward from the rotational axis of the main rotor and into the heavy fluid chamber for removing heavy fluids from the chamber;

a light fluid chamber attached to the rotor;

a light fluid scoop mounted in the opening in the rotor and having a low passage extending outward from the rotation axis of the main rotor and into the light fluid chamber for removing light fluids from the chamber;

a weir connected to the main rotor adjacent to the light fluid chamber and extending radially inwardly from the rotor wall a distance sufficient to permit light fluids to overflow the weir and enter the light fluid chamber;

a first float in the opening in the main rotor floating on a first fluid interface and adapted for radial movement with respect to the rotational axis of the rotor;

a second float in the opening in the main rotor floating on a second fluid interface and adapted for radial movement with respect to the rotational axis of the rotor;

a first detector for radially locating the first float and producing a signal relative thereto;

a second detector for radially locating the second float and producing a signal relative there to;

a first signal converter in communication with the first detector capable of receiving the signal produced by the first detector and producing a varying output signal to a means for regulating flow through the heavy fluid scoop;

a second signal converter in communication with the second detector capable of receiving the signal produced by the second detector and producing a varying output signal to a means for regulating flow through the light fluid scoop;

a means for regulating flow through the heavy fluid scoop in response to the varying output signal from the first signal converter, whereby maintaining a specified heavy fluid level; and a means for regulating flow through the light fluid scoop in response to the varying output signal from the second signal converter, whereby maintaining a specified light fluid level.

24. The apparatus of claim 23 further adapted to additionally handle gas, and further comprising:

a third fluid scoop mounted in the opening in the rotor and having a flow passage extending outward from the rotational axis of the main rotor for removing gas from the rotor; and a pressure regulating device communicating with the third flow passage, whereby a specified rotor pressure is maintained.

25. The apparatus of claim 24 and further comprising:

a fluid acceleration impeller adapted for rotation with the rotor and capable of receiving fluid from the fluid feed flow passage; and a coalescing material adapted for rotation with the rotor.

26. The apparatus of claim 23 and further comprising:

a fluid acceleration impeller adapted for rotation with the rotor and capable of receiving fluid from the fluid feed flow passage; and a coalescing material adapted for rotation with the rotor.

27. An apparatus for separating the compounds of a stream comprised of a plurality of fluids having different specific gravities, said apparatus comprised of:

a rotor adapted for rotation about an axis, the rotor having a rotor wall, and opposed first and second end portions defining an opening inside the rotor;

a fluid feed flow passage mounted in the opening in the rotor to introduce the stream into the rotor;

a liner attached to the rotor creating a flow passage between the liner and the rotor along the rotor;

a heavy fluid chamber attached to the rotor;

a heavy fluid scoop mounted in the opening in the rotor and having a flow passage extending outward from the rotational axis of the rotor and into the heavy fluid chamber for removing heavy fluids from the chamber;

a light fluid chamber attached to the rotor;

a light fluid scoop mounted in the opening in the rotor and having a flow passage extending outward from the rotational axis of the rotor and into the light fluid chamber for removing light fluids from the chamber;

a weir connected to the rotor adjacent to the light fluid chamber and extending radially inwardly from the rotor wall a distance sufficient to permit light fluids to overflow the weir and enter the light fluid chamber;

a skim oil fluid chamber attached to the rotor;

a skim oil fluid removal scoop mounted in the opening in the rotor and having a flow passage extending outward from the fluid feed flow passage and into the skim oil fluid chamber, whereby removing skim oil from the chamber for reseparating in the rotor;

a first detector for radially locating a first fluid layer interface and producing a signal relative thereto;

a second detector for radially locating a second fluid layer interface and producing a signal relative thereto;

a first signal converter in communication with the first detector capable of receiving the signal produced by the first detector and producing a varying output signal to a means for regulating flow through the heavy fluid scoop;

a second signal converter in communication with the second detector capable of receiving the signal produced by the second detector and producing a varying output signal to a means for regulating flow the light fluid scoop;

a means for regulating flow through the heavy fluid scoop in response to the varying output signal from the first signal converter, whereby maintaining a specified heavy fluid level; and a means for regulating flow through the light fluid scoop in response to the varying output signal from the second signal converter, whereby maintaining a specified light fluid level.

28. The apparatus of claim 27 and further comprising:

a third fluid scoop mounted in the opening in the rotor and having a flow passage extending outward from the rotational axis of the main rotor for removing gas from the rotor; and a pressure regulating device communicating with the third flow passage, whereby a specified rotor pressure is maintained.

29. The apparatus of claim 28 and further comprising:

a fluid acceleration impeller adapted for rotation with the rotor and capable of receiving fluid from the fluid feed flow passage;

a first coalescing material in the flow passage between the liner and the rotor; and a second coalescing material on the inner surface of the liner.

30. The apparatus of claim 27 and further comprising:

a fluid acceleration impeller adapted for rotation with the rotor and capable of receiving fluid from the fluid feed flow passage;

a first coalescing material in the flow passage between the liner and the rotor; and a second coalescing material on the inner surface of the liner.

31. An apparatus for separating the components of a stream comprised of a plurality of fluids having different specific gravities, said apparatus comprised of:

a rotor adapted for rotation about an axis, the rotor having a rotor wall and opposed first and second end portions defining an opening inside the rotor;

a fluid feed flow passage mounted in the opening in the rotor to introduce the stream into the rotor;

a liner attached to the rotor creating a flow passage between the liner and the rotor along the rotor;

a heavy fluid chamber attached to the rotor;

a heavy fluid scoop mounted in the opening in the rotor and having a flow passage extending outward from the rotational axis of the rotor and into the heavy fluid chamber for removing heavy fluids from the chamber;

a light fluid chamber attached to the rotor;

a light fluid scoop mounted in the opening in the rotor and having a flow passage extending outward from the rotational axis of the rotor and into the light fluid chamber for removing light fluids from the chamber;

a weir connected to the rotor adjacent to the light fluid chamber and extending radially inwardly from the rotor all a distance sufficient to permit light fluids to overflow the weir and enter the light fluid chamber;

a skim oil fluid chamber attached to the rotor;

a skim oil fluid removal scoop mounted in the opening in the rotor and having a flow passage extending outward from the fluid feed flow passage and into the skim oil fluid chamber, whereby removing skim oil from the chamber for reseperation in the rotor;

a first float in the opening in the main rotor floating on a first fluid interface and adapted for radial movement with respect to the rotational axis of the rotor;

a float in the opening in the main rotor floating on a second fluid interface and adapted for radial movement with respect to the rotational axis of the rotor;

a first detector for radially locating the first float and producing a signal relative thereto;

a second detector for radially locating the second float and producing a signal relative thereto;

a first signal converter in communication with the first detector capable of receiving the signal produced by the first detector and producing a varying output signal to a means for regulating flow through the heavy fluid scoop;

a second signal converter in communication with the second detector capable of receiving the signal produced by the second detector and producing a varying output signal to a means for regulating flow through the light fluid scoop;

a means for regulating flow through the heavy fluid scoop in response to the varying output signal from the first signal converter, whereby maintaining a specified heavy fluid level; and a means for regulating flow through the light fluid scoop in response to the varying output signal from the second signal converter, whereby maintaining a specified light fluid level.

32. The apparatus of claim 31 and further comprising:

a third fluid scoop mounted in the opening in the rotor and having a flow passage extending outward from the rotational axis of the main rotor for removing gas from the rotor; and a pressure regulating device communicating with the third flow passage, whereby a specified rotor pressure is maintained.

33. The apparatus of claim 32 and further comprising:

a fluid acceleration impeller adapted for rotation with the rotor and capable of receiving fluid from the fluid feed passage;

a first coalescing material in the flow passage between the liner and the rotor; and a second coalescing material on the inner surface of the liner.

34. The apparatus of claim 31 and further comprising:

a fluid acceleration impeller adapted for rotation with the rotor and capable of receiving fluid from the fluid feed flow passage;

a first coalescing material in the flow passage between the liner and the rotor; and a second coalescing material on the inner surface of the liner.

35. An apparatus for separating the components of a stream comprised of a plurality of fluids having different specific gravities and particulates, said apparatus comprised of:

a main rotor adapted for rotation about an axis, the main rotor having a rotor wall and opposed first and second end portions defining an opening inside the rotor;

an inner rotor mounted inside of the main rotor adapted for rotation with the main rotor, said inner rotor having an inner rotor wall defining an opening inside the inner rotor and being adapted to receive flow from a fluid feed flow passage;

a sand/water scoop mounted in the opening in the inner rotor and having a flow passage extending outward from the rotational axis of the main rotor and inner rotor to the wall of the inner rotor for removing sand from the inner rotor;

a sand/water outlet orifice communications with the flow passage of the sand/water scoop;

a water makeup line mounted in the opening in the inner rotor and having a flow passage extending outward from the rotational axis of the main rotor and inner rotor into said inner rotor;

a water inlet orifice communicating with flow passage of the water makeup line;

a fluid feed flow passage mounted in the opening in the inner rotor to introduce the stream into the inner rotor;

a liner attached to the main rotor creating a flow passage between the liner and the main rotor along the main rotor;

a heavy fluid chamber attached to the main rotor;

a heavy fluid scoop mounted in the opening in the rotor and having a flow passage extending outward from the rotational axis of the main rotor and into the heavy fluid chamber for removing heavy fluids from the chamber;

a light fluid chamber attached to the main rotor;

a light fluid scoop mounted in the opening in the rotor and having a flow passage extending outward from the rotational axis of the main rotor and into the light fluid chamber for removing light fluids from the chamber;

a weir connected to the main rotor adjacent to the light fluid chamber and extending radially inwardly from the rotor wall a pre-selected distance sufficient to permit light fluids to overflow the weir and enter the light fluid chamber;

a skim oil fluid chamber attached to the main rotor;

a skim oil fluid removal scoop mounted in the opening in the rotor and having a flow passage extending outward from the fluid feed flow passage and into the skim oil fluid chamber, whereby removing skim oil from the chamber for reseparation in the main rotor;

a first detector for radially locating as first fluid layer interface and producing a signal relative thereto;

a second detector for radially locating a second fluid layer interface and producing a signal relative thereto;

a first signal converter in communication with the first detector capable of receiving the signal produced by the first detector and producing a varying output signal to a means for regulating flow through the heavy fluid scoop;

a second signal converter in communication with the second detector capable of receiving the signal produced by the second detector and producing a varying output signal to a means for regulating flow through the light fluid scoop;

a means for regulating flow through the heavy fluid scoop in response to the varying output signal from the first signal converter, whereby maintaining a specified heavy fluid level; and a means for regulating flow through the light fluid scoop in response to the varying output signal from the second signal converter, whereby maintaining a specified light fluid level.

36. The apparatus of claim 35 and further comprising:

a third fluid scoop mounted in the opening in the rotor and having a flow passage extending outward from the rotational axis of the main rotor for removing gas from the rotor; and a pressure regulating device communicating with the third flow passage, whereby a specified rotor pressure is maintained.

37. The apparatus of claim 36 and further comprising:

a fluid acceleration impeller adapted for rotation with the rotor and capable of receiving fluid from the fluid feed flow passage;

a first coalescing material in the flow passage between the liner and the rotor; and a second coalescing material on the inner surface of the liner.

38. The apparatus of claim 35 and further comprising:

a fluid acceleration impeller adapted for rotation with the rotor and capable of receiving fluid from the fluid feed flow passage;

a first coalescing material in the flow passage between the liner and the rotor; and a second coalescing material on the inner surface of the liner.

39. An apparatus for separating the components of a stream comprised of a plurality of fluids having different specific gravities and particulates, said apparatus comprised of:

a main rotor adapted for rotation about an axis, the main rotor having a rotor wall and opposed to first and second end portions defining an opening inside the rotor;

an inner rotor mounted inside of the main rotor adapted for rotation with the main rotor, said inner rotor having an inner rotor wall defining an opening inside the inner rotor and being adapted to receive flow from a fluid feed flow passage;

a sand/water scoop mounted in the opening in the inner rotor and having a flow passage extending outward from the rotational axis of the main rotor and inner rotor to the wall of the inner rotor for removing sand from the inner rotor;

a sand/water outlet orifice communications with the flow passage of the sand/water scoop;

a water makeup line mounted in the opening in the inner rotor and having a flow passage extending outwardly from the rotational axis of the main rotor and inner rotor into said inner rotor;

a water inlet orifice communicating with the flow passage of the water makeup line;

a fluid feed flow passage mounted in the opening in the inner rotor to introduce the stream into the inner rotor;

a liner attached to the main rotor creating a flow passage between the liner and the main rotor along the main rotor;

a heavy fluid chamber attached to the main rotor;

a heavy fluid scoop mounted in the opening in the rotor and having a flow passage extending outward from the rotational axis of the main rotor and into the heavy fluid chamber for removing heavy fluids from the chamber;

a light fluid chamber attached to the main rotor;

a light fluid scoop mounted in the opening in the rotor and having a flow passage extending outward from the rotational axis of the main rotor and into the light fluid chamber for removing light fluids from the chamber;

a weir connected to the main rotor adjacent to the light fluid chamber and extending radially inwardly from the rotor wall a distance sufficient to permit light fluids to overflow the weir and enter the light fluid chamber;

a skim oil fluid chamber attached to the main rotor;

a skim oil fluid removal scoop mounted in the opening in the rotor and having a flow passage extending outward from the fluid feed flow passage and into the skim oil fluid chamber, whereby for removing skim oil from the chamber for reseparation in the main rotor;

a first float in the opening in the main rotor floating on a first fluid interface and adapted for radial movement with respect to the rotational axis of the rotor;

a second float in the opening in the main rotor floating on a second fluid interface and adapted for radial movement with respect to the rotational axis of the rotor;

a first detector for radially locating the first float and producing a signal relative thereto;

a second detector for radially locating the second float and producing a signal relative thereto;

a first signal converter in communication with the first detector capable of receiving the signal produced by the first detector and producing a varying output signal to a means for regulating flow through the heavy fluid scoop;

a second signal converter in communication with the second detector capable of receiving the signal produced by the second detector and producing a varying output signal to a means for regulating flow through the light fluid scoop;

a means for regulating flow through the heavy fluid scoop in response to the varying output signal from the first signal converter, whereby maintaining a specified heavy fluid level; and a means for regulating flow through the light fluid scoop in response to the varying output signal from the second signal converter, whereby maintaining a specified light fluid level.

40. The apparatus of claim 39 and further comprising:

a third fluid scoop mounted in the opening in the rotor and having a flow passage extending outward from the rotational axis of the main rotor for removing gas from the rotor; and a pressure regulating device communicating with the third flow passage, whereby a specified rotor pressure is maintained.

41. The apparatus of claim 40 and further comprising:

a fluid acceleration impeller adapted for rotation with the rotor and capable of receiving fluid from the fluid feed flow passage;

a first coalescing material in the flow passage between the liner and the rotor; and a second coalescing material on the inner surface of the liner.

42. The apparatus of claim 39 and further comprising:

a fluid acceleration impeller adapted for rotation with the rotor and capable of receiving fluid from the fluid feed flow passage;

a first coalescing material in the flow passage between the liner and the rotor; and a second coalescing material on the inner surface of the liner.

* * * * *